US006639564B2

(12) United States Patent
Johnson

(10) Patent No.: US 6,639,564 B2
(45) Date of Patent: Oct. 28, 2003

(54) DEVICE AND METHOD OF USE FOR REDUCING HEARING AID RF INTERFERENCE

(76) Inventor: Gregory F. Johnson, 1931 Seascape Blvd., Aptos, CA (US) 95003

( * ) Notice: Subject to any disclaimer, the term of this patent is extended or adjusted under 35 U.S.C. 154(b) by 0 days.

(21) Appl. No.: 10/262,447

(22) Filed: Sep. 30, 2002

(65) Prior Publication Data

US 2003/0151557 A1 Aug. 14, 2003

Related U.S. Application Data

(60) Provisional application No. 60/357,162, filed on Feb. 13, 2002.

(51) Int. Cl.[7] ..... H01Q 1/24

(52) U.S. Cl. ..... 343/702; 343/700 MS; 343/718; 381/316

(58) Field of Search ..... 343/700 MS, 702, 343/718; 381/315, 316, 321, 322

(56) References Cited

U.S. PATENT DOCUMENTS 5,819,162 A * 10/1998 Spann et al. ..... 455/90
5,966,097 A 10/1999 Fukasawa et al. ..... 343/700
6,009,311 A * 12/1999 Killion et al. ..... 455/63
6,031,923 A * 2/2000 Gnecco et al. ..... 381/322
6,084,975 A * 7/2000 Perkins ..... 381/326
6,114,996 A 9/2000 Nghiem ..... 343/700
6,137,888 A * 10/2000 McClennon et al. ..... 381/318
6,147,652 A 11/2000 Sekine ..... 343/702
6,229,487 B1 5/2001 Sadler et al. ..... 343/700
6,320,545 B1 11/2001 Nagumo et al. ..... 343/700
6,404,395 B1 6/2002 Masuda ..... 343/702
6,448,931 B1 9/2002 Deguchi et al. ..... 343/700
6,518,922 B1 2/2003 Hoffmeister ..... 343/700

* cited by examiner

*Primary Examiner*—Don Wong
*Assistant Examiner*—Shih-Chao Chen

(57) ABSTRACT

An apparatus for reducing hearing aid radio frequency (RF) interference including a directional multi-band and/or single band antenna for use with PWDs such as digital cellphones is disclosed. The apparatus greatly reduces or eliminates the audio noise induced in hearing aids by the PWDs and allows operation of a hearing aid during PWD operation. In operation, the apparatus may be provided on the PWD side away from the user's head. The apparatus may be integrated into the PWB during its manufacture or provided as an after market assembly for a PWD that has a port for connection of an external antenna. The apparatus provides for improved front-to-back ratio as compared to antennas currently in use on PWD's, and therefore also reduces SAR (specific absorption rate), the level of RF energy received into the head by a PWD.

27 Claims, 10 Drawing Sheets

DEVICE AND METHOD OF USE FOR REDUCING HEARING AID RF INTERFERENCE

RELATED APPLICATION

This application claims the benefit of priority pursuant to 35 U.S.C. 119 of Provisional Patent Application Ser. No. 60/357,162, filed Feb. 13, 2002, which entire application is incorporated by reference herein.

BACKGROUND OF THE INVENTION

1. Field of the Invention

The present invention relates to a device for reducing rf-induced audio noise generated within a hearing aid of a user of an associated portable wireless device (PWD). Additionally, the present invention relates to a device for reducing the specific absorption rate (SAR) of the associated PWD during operation.

2. Description of the Related Art

In-ear hearing aid use may be limited during operation of certain types of PWDs due to rf-induced audio noise generated within the hearing aid while in operation near a transmitting PWD. The noise is induced during PWD transmission as an electromagnetic field from the PWD induces currents in the circuitry of the hearing aid. The electromagnetic field from the PWD causes components within the hearing aid to generate audio noise, the noise being particularly related to the frequencies of the digital portion of the PWD. Solutions to this problem having included: moving the PWD away from the ear/head by providing a 2-way audio link between the remote PWD and the ear. Two types of such audio links are a) a "docking station" for the PWD that has microphone/speaker, and b) a "T-coil" that couples audio from the cellphone into the hearing aid. Another solution to the problem has been a wired connection of a microphone/speaker unit from the PWD to the vicinity of the user's head. The microphone/speaker unit requires insertion of a small "speaker" into the user's ear, which may not be possible for the user of an in-ear hearing aid. Further, the wire(s) may allow RF to flow from the PWD's antenna system into the microphone/speaker unit and subsequently cause similar audio noise as if the PWD were near the head.

A solution to this hearing aid noise / PWD problem that permits the hearing impaired to use a conventional PWD, particularly a digital cellphone, in the normal manner without an accessory speaker/microphone device would be desirable.

Current digital cellphones are designed for operation on multiple frequency bands, for instance the 824–894 and 1850–1990 MHz bands in the US. Band selection is done without user input, and is determined by band availability in a particular geographical area. Both US frequency bands provide digital service, therefore a solution to the hearing aid noise problem caused by digital cellphones must be compatible with each frequency bands used by the cellphone.

SAR (specific absorption rate) for users of PWDs is a matter of increasing concern. RF radiation to the user's head results from the free-space generally omnidirectional radiation pattern of typical current PWD antennae. When PWDs equipped with such an antenna are placed near the user's head, the antenna radiation pattern is no longer omnidirectional as radiation in a large segment of the azimuth around the user is blocked by the absorption/reflection of the head. An antenna system for PWDs that greatly reduces radiation to the body and redirects it in a useful direction is also desirable.

FIG. 1 illustrates a prior art dual-band PIFA antenna 30, which is located on the rear of a personal wireless device ("PWD") 32, and electrically connected to ground plane 34 at one end and capacitively coupled to ground plane 34 at another end. PWD 32 further includes a battery pack 35 positioned away from antenna 30. In normal operation, PWD 32 is oriented in an upright manner so that end 38 is generally above end 40. Ground plane 34 is provided by the ground traces of the printed wiring board (PWB) of PWD 32. The portion of antenna 30 indicated by numeral 42 resonates over a higher frequency band, while the entire portion 42, 44 of antenna 30 resonates over a lower frequency band. PIFA antenna 30 is grounded at its upper end at location indicated as numeral 46 to ground plane 34. PIFA antenna 30 is capacitively coupled at pad 48 in a direction away from upper end 38 of PWD. This type of antenna provides some reduction in SAR, but cannot eliminate hearing aid noise from a digital PWD.

Referring to FIG. 2, a perspective view of a prior art PWD 32 (in the form of a cellphone) used in the vicinity of a hearing aid 60 is illustrated. Cellphone 32 has a speaker on the keyboard surface near the top of the phone, which is normally aligned with the center of the user's ear 62 during use. Hearing aid 60 may be any type, including in-ear and behind-ear variations. Hearing aid 60 has an amplified audio output port 4, which is inserted into the ear canal of the ear 62. During operation, an electromagnetic field 64 is generated around cellphone 32 by omnidirectional antenna 66. In operation, electromagnetic field 64 illuminates the hearing aid 60, user's ear 62, and the user's head. RF noise is induced in the hearing aid by the field 64, resulting in excessive audio noise being presented to the user.

SUMMARY OF THE INVENTION

The device of the present invention greatly reduces radiation directed toward a user's head and hearing aid during device operation. As a result, the device promotes a reduction or elimination of hearing aid noise and SAR. Other benefits include longer transmit/receive range, lower transmit power, and longer battery life.

A device according to the present invention may include a PWD implemented for operation over single or multiple frequency-bands. An antenna may be incorporated within a PWD at the time of manufacture, or may be provided as an accessory or after market item to be added to existing PWD's having an external antenna port. The latter feature is particularly useful, in that existing PWD's can be retrofitted to achieve the benefits of the antenna of the present invention, including elimination of hearing aid noise and very low SAR. The antenna of the present invention is suitable for high-volume, low cost manufacturing. The antenna/PWD combination, whether an aftermarket or original equipment item, may be placed in a leather or plastic case, such that the antenna side of the PWD is facing away from the body. This provides a further advantage with respect to SAR, when the PWD is stored via a belt clip when in receive-only mode.

Other objects of the present invention include:

the elimination (or substantial reduction) of audio noise in hearing aids caused by close proximity to transmitting PWDs, particularly digital cellphones;

the elimination (or substantial reduction) of audio noise in hearing aids caused by close proximity to transmitting PWDs, particularly PWD's operating in one or more frequency bands, enabling use of hearing aids in close proximity to such PWDs;

the reduction in SAR due to operation of a single or multi-band PWD near the user's head;

the provision of an antenna suitable for integration within or upon a PWD;

the provision of an antenna having wide bandwidth in one or more frequency bands;

the provision of an antenna having one or more active elements and one or more passive elements, each resonant on one or more frequency bands;

the provision of an antenna which radiates RF energy from a PWD preferentially away from a user thereof;

the provision of an antenna promoting increased PWD battery life by reducing commanded RF power;

the provision of an antenna having a reduction in the amount of RF energy beingabsorbed by a user's hand during operation; and the provision of an antenna with the one or more active element(s) connected to a PWD's transmit/receive port.

These and further objects of the present invention will become apparent to those skilled in the art with reference to the accompanying drawings and detailed description of preferred embodiments, wherein like numerals refer to like parts throughout.

DETAILED DESCRIPTION OF THE INVENTION

Figure 1:
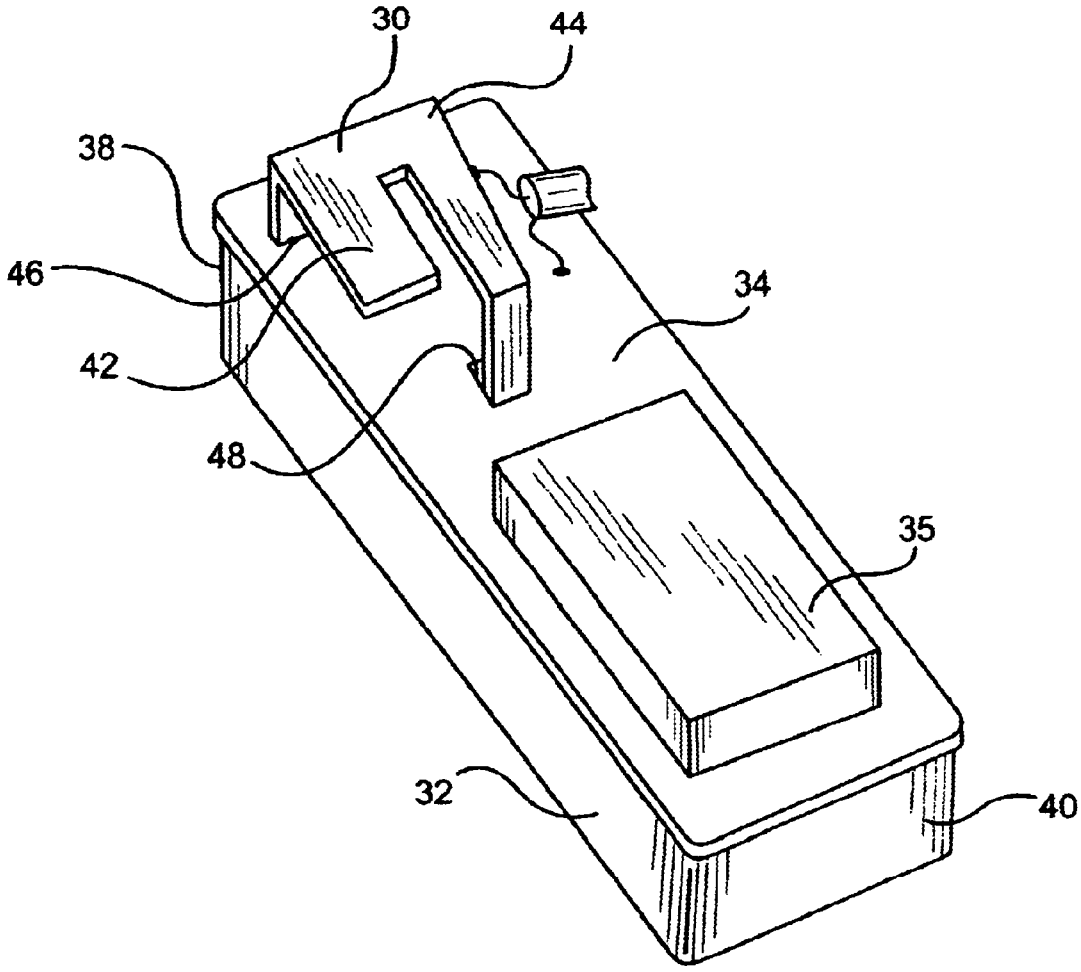
FIG. 1 PRIOR ART
FIG. 1 illustrates a prior art wireless communications device having a known PIFA-type antenna assembly.
Figure 2:
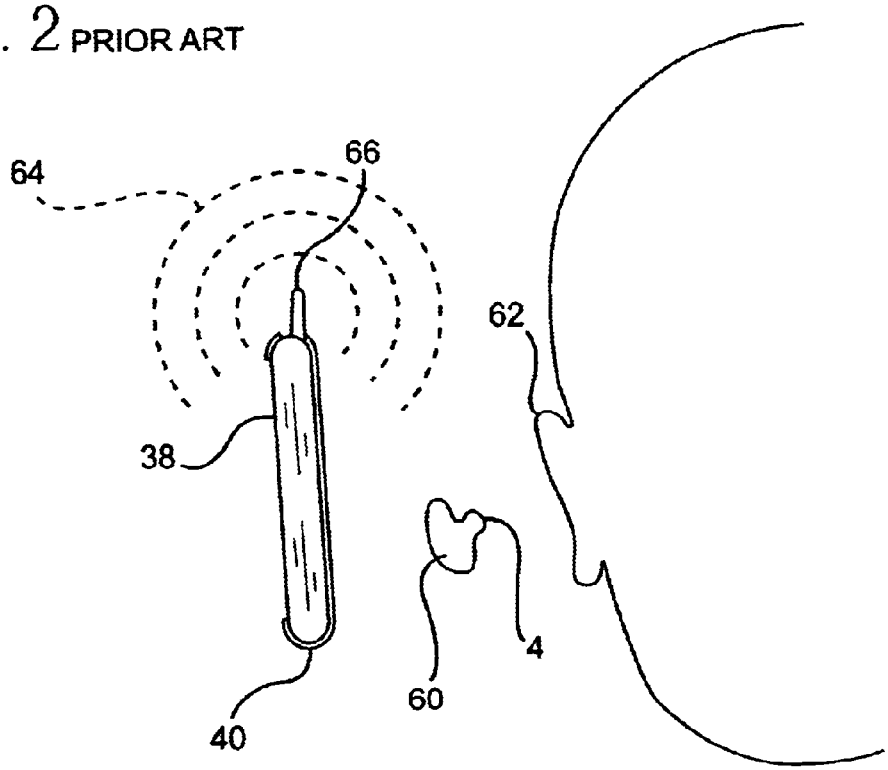
FIG. 2 PRIOR ART
FIG. 2 depicts operation of a wireless communications device, such as a cellular phone, in proximity to a hearing aid and user.
Figure 3:
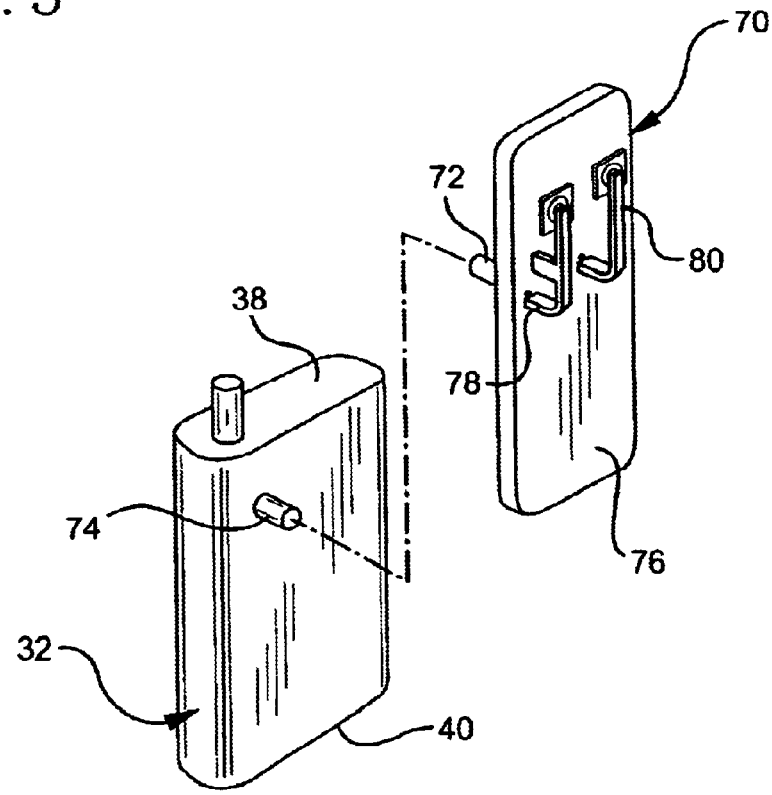
FIG. 3 is a perspective view of a first embodiment of a device according to the present invention.
Figure 4:
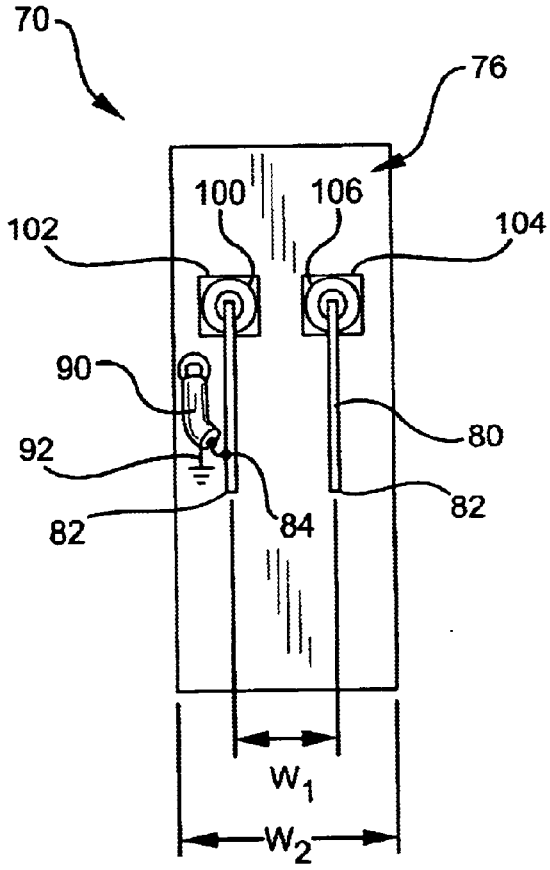
FIG. 4 is a top plan view of the device embodiment of FIG. 3.
Figure 5:
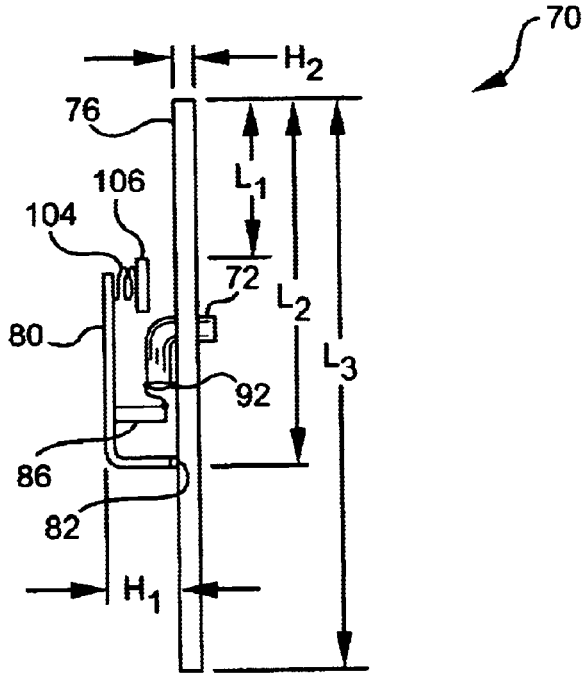
FIG. 5 is a side view of the device embodiment of FIGS. 3 and 4.

Referring to FIGS. 3 through 5, an antenna device according to one embodiment of the present invention is indicated as numeral 70. Device 70 comprises an external assembly which may be provided as an aftermarket device to improve PWD 32 performance. Device 70 has an RF port 72 which connects into an external antenna port 74 of the PWD 32. In alternative embodiments, device 70 may be connected via a coaxial cable or other type of transmission line.

Device 70 includes a conductor element 76 and a pair of configured conductive radiating elements 78, 80. Element 76 may be a planar conductive element, or may be configured to have some curvature or other shape. Element 76 preferably has an electrical length in the range of 0.3 to 0.8 wavelength for a frequency within the band of operation. Element 76 may be formed as a metal part or may be a plating or conductive layer disposed upon a support element, such as a housing, etc. Further, at least a portion of element 76 may be provided by the ground traces of the printed wiring board of a PWD within or upon which antenna 70 is located.

Each of the conductors 78, 80 has a free end and is conductively connected to element 76 at an opposite end as indicated by numeral 82 in FIGS. 4 and 5. A feedpoint 84, having a desired impedance, is defined along conductor 78. A short conductor 86 is attached at feedpoint 84. Conductor 86 is connected to the center conductor of a coaxial line 90. An outer shield of line 90 connects to conductor element 76 at location 92. In alternative embodiments, coax line 90 may be replaced by a microstrip or other type of transmission line.

In the embodiment of FIGS. 3–5, transmission line 90 connects to RF connector 72, which is selected to match the connector used for the external antenna port 74 on WCD 32. Although connector 72 is shown exiting the back side of element 76, it may take any other route as required to plug into the WCD's external antenna port. Antenna device 70 may also be incorporated into a WCD at the time of manufacture, in which case transmission line 90 would directly connect to the RF input/output point of the WCD's transceiver.

Elements 78, 80 are designed to resonant over one or more frequency bands. As an example, conductor 78, which is a fed element, may be resonant at a higher frequency band, with inductor 100 and conductor 102 acting as a "trap" or electrical stop for said higher frequency band. The term "LC trap" as used herein is defined to mean either a inductor/capacitance trap or an inductive trap. Coil 100 and conductor 76 may be selected so as to cause the combination of elements 78, 100, and 102 to resonate at a lower frequency band, thus providing a dual-band element having one feedpoint.

Element 80, which is not directly connected to feedline 90, may have its length adjusted to resonate over the same or nearly the same frequency bands as 78. Inductor 104 and conductor 106 may be selected to act as a "trap" or stop for the said higher frequency band, and the combination of elements 80, 104, and 106 may be selected to resonate at a lower frequency band, which may be the same or nearly the same as that of elements 78, 100, and 102. Again, a greater bandwidth in a lower frequency band is attained with two adjacent elements (78, 100, 102) and (80,104,106) than with a single element. The higher frequency band may be 1850–1990 MHz, and the lower frequency band may be 824–894 MHz. A range and preferred values of dimensions for these frequency bands are as follows;

| Dimension | Range | Preferred Dimension |
|---|---|---|
| W1 | 0.25–1.525 in. | 0.75 in. |
| W2 | 1–6 in. | 1.6 in. |
| H1 | 0.3–2 in. | 0.75 in. |
| H2 | 0.001–0.5 in. | 0.02 in. |
| L1 | 1.5–4 in. | 2.75 in. |
| L2 | 0.5–4 in. | 1 in. |
| L3 | 4–8 in. | 5.25 in. |

Conductors 78, 80 may have any cross section, including round and rectangular. One preferred cross section is 0.05 in. diameter round wire.

Conductor 76 length, L3, is greater than the length of elements 78 and 80. Conductor 76 may be defined by a plurality of conductive trace elements on a dielectric board, such as a printed wiring board. Through additional experimentation by those skilled in the relevant arts, the traces may assume a variety of configurations.

Element 78 and 80 are oriented upon conductor 76 so that the free ends of the elements 78, 80 are above the connection ends 82 during device operation. In other words, during device operation, elements 78, 80 are upwardly directed. In a typical operation of PWD 32, elements 78, 80 would be more or less perpendicular to the floor or ground surface upon which the operator is positioned. For an embodiment of antenna 70 which is integrated within a PWD 32, elements 78, 80 are secured at first ends to conductor 76 and have free ends extending in a direction toward the top of PWD 32.

Figure 6:
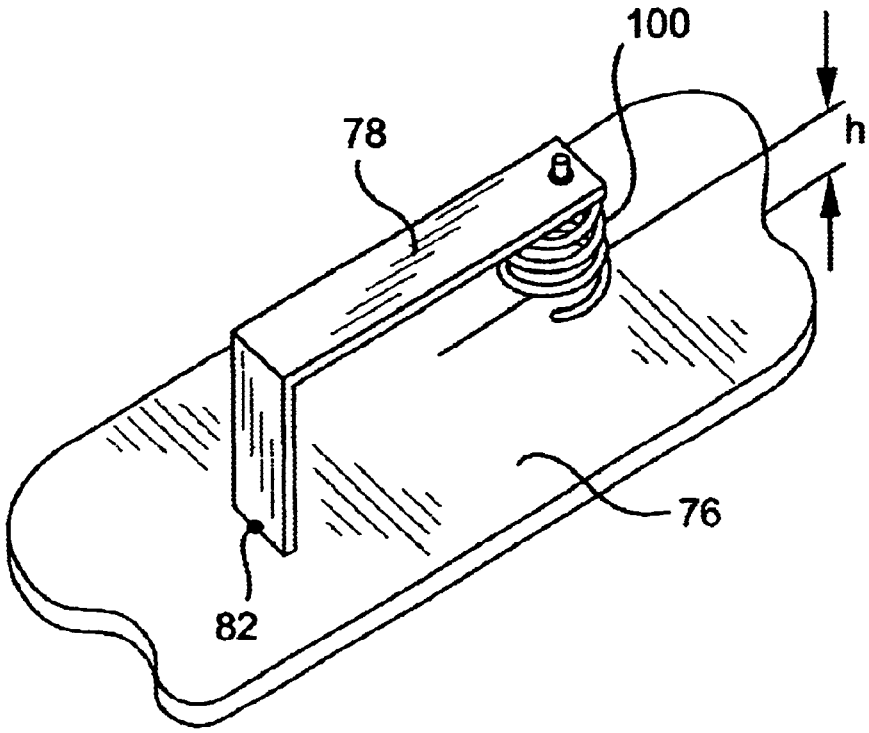
FIG. 6 is a perspective partial view of another embodiment of the present invention.

FIG. 6 shows another embodiment of the element 78 and trap inductor 100. Inductor 100 is a wire element having windings which may be uniformly spaced or which may be non-uniformly spaced. In this particular embodiment, inductor windings 100 are more closely spaced proximate to element 78 than proximate to the conductor element 76, i.e., the "pitch" of the wire winding varies across its length. The resonant frequency of the combination 78 and 100 may be adjusted by varying height "h".

Figure 7:
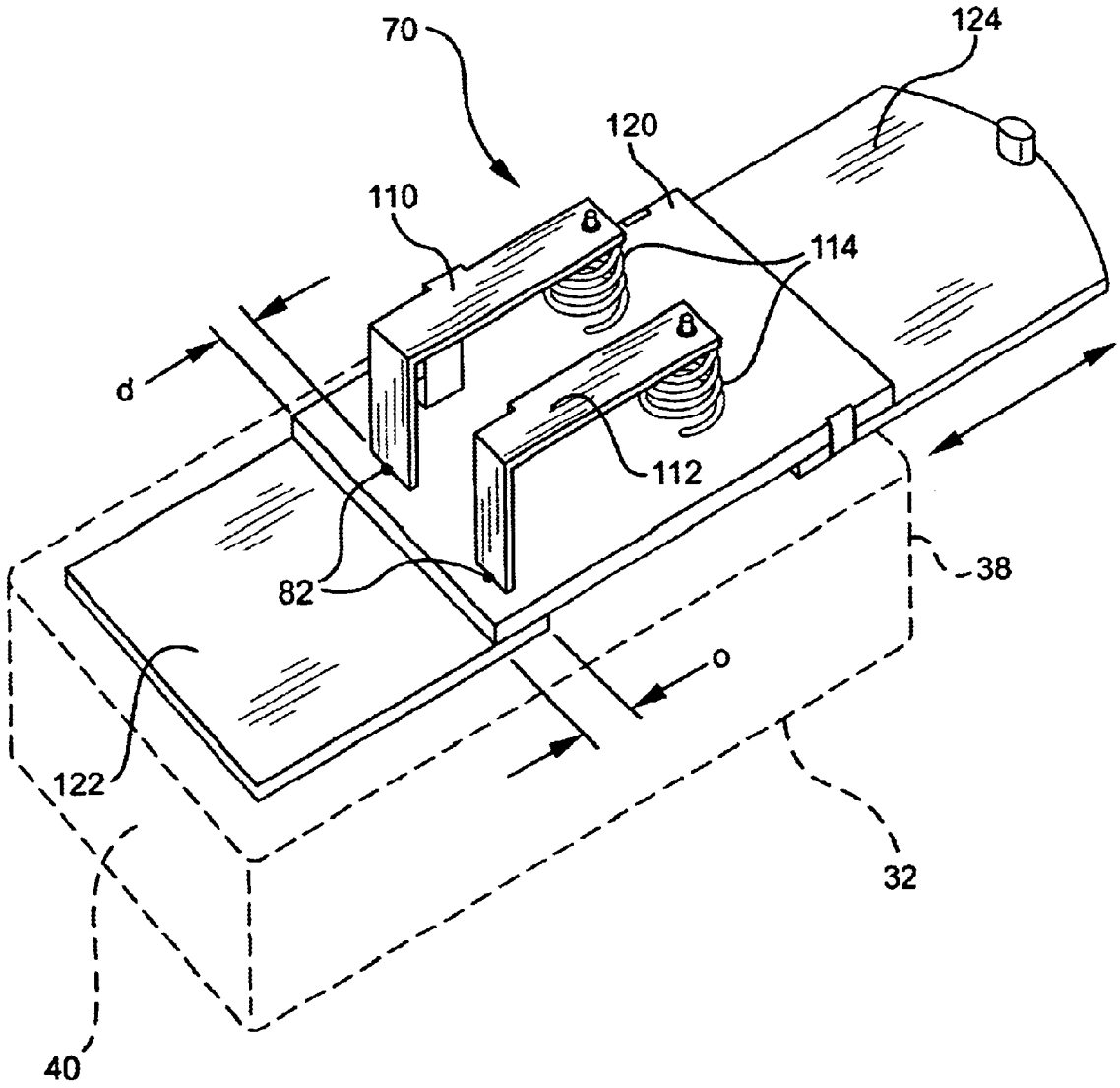
FIG. 7 is a perspective view of yet another embodiment of a device according to the present invention.

FIG. 7 illustrates features of another embodiment of an antenna device 70 according to the present invention. Radiating elements 110, 112 are coupled at a position relative far away from the top 38 of the PWD 32, and the open ends 114 of elements 110, 112 are in a direction toward the top of the PWD 32, e.g. during normal operation open ends 114 of elements 110, 112 are upwardly directed (e.g., away from a floor surface).

The ground plane required for the antenna system 70 may be provided separately from that within the PWD 32, by conductive segments 120, 122 and 124. Segments 120, 122 may be capacitively coupled within the overlap region "O". Segments 124, 120 are electronically connected, and segment 124 may slide in and out relative to 120 to reduce size, when the PWD 32 is not in use. Segment 124 may be manually retracted as during PWD 32 operation. In alternative embodiments, segment 124 may be automatically extended during operation, such as via a small solenoid, motor and gearing, etc.

Figure 8:
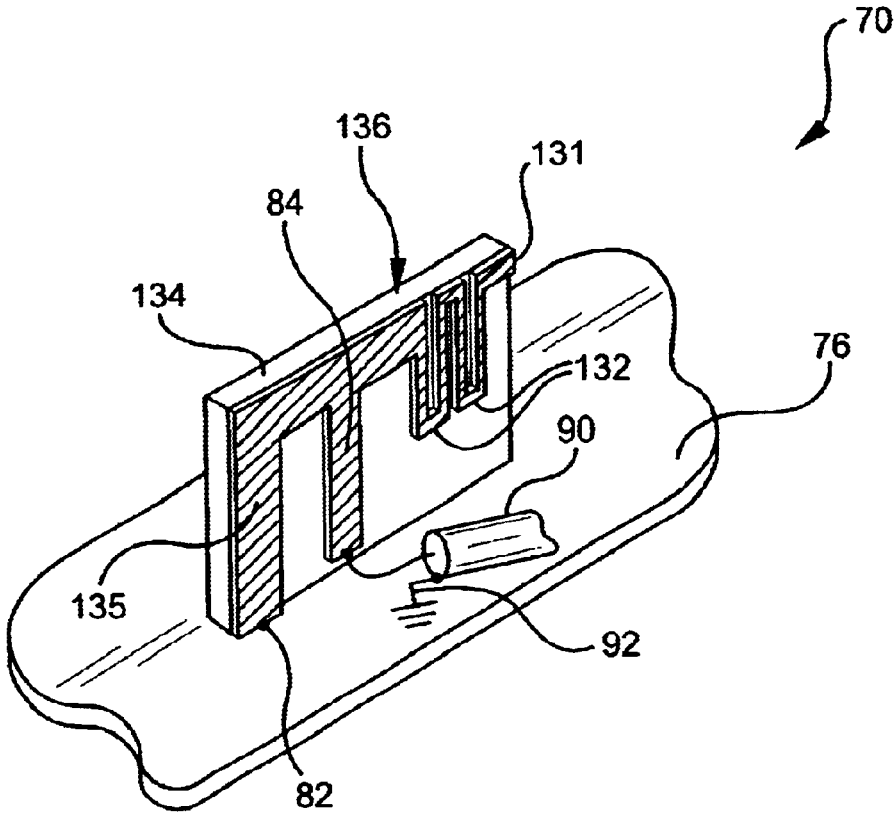
FIG. 8 is a perspective partial view of another embodiment of the present invention.

Referring to FIG. 8, an alternative embodiment of a driven element 136 of the antenna 70 of the present invention is shown. In this embodiment, PWB (printed wiring board) technology is utilized to facilitate close dimensional tolerances for the antenna. A dielectric printed wiring board 134, which may have a dielectric constant in the range 2–30, is used to support the element conductors 131, 132, 135. The feed point is indicated as numeral 84. Connection point to coax line 90 is indicated as numeral 133. Meander line inductor 132 corresponds to inductor 100 from FIGS. 3–5. Although meander line inductor 132 is shown as a meander line on one surface of the PWB 134, one skilled in the art would recognize that it could also be implemented as traces occupying both sides of PWB 134, with plated-through holes ("vias") connected the line segments. Although the driven elements 131, 132, 135 alone are depicted in FIG. 8, the same construction may be used to fabricate the non-driven element as well.

Figure 9:
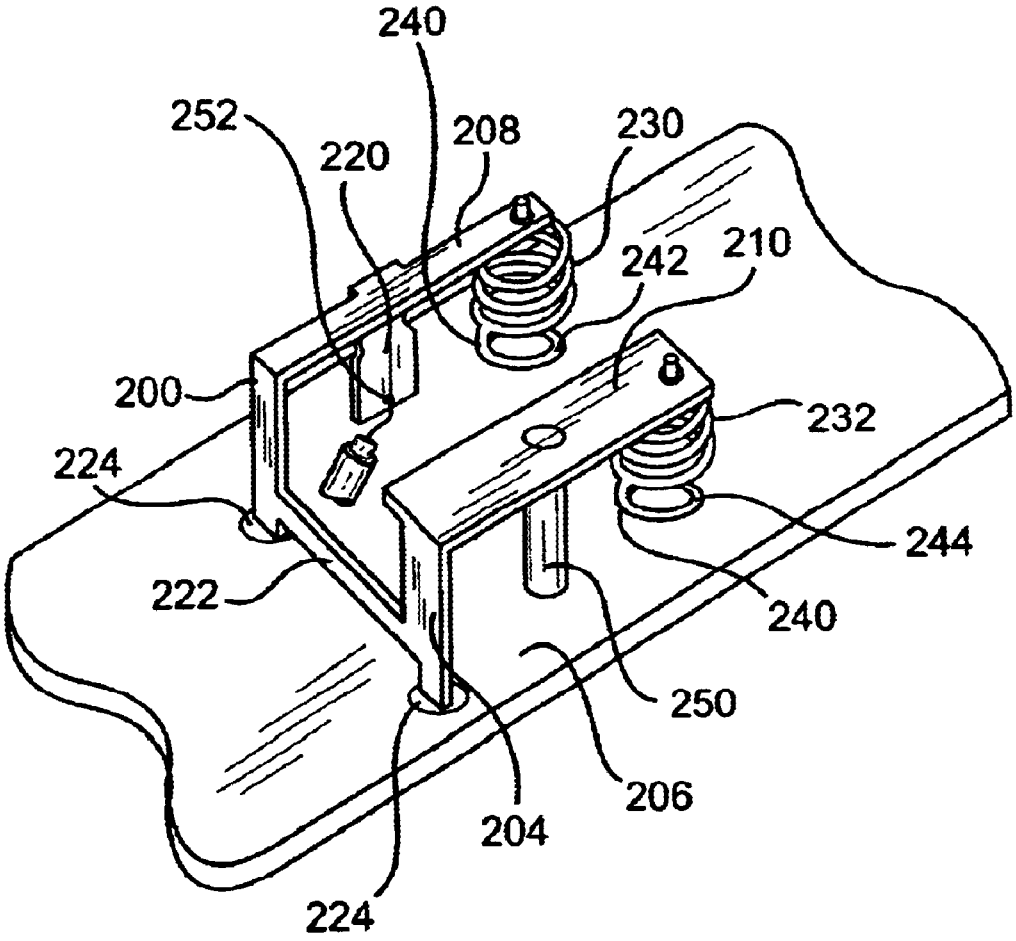
FIG. 9 is a perspective view of yet another embodiment of a device according to the present invention.

Referring to FIG. 9, another embodiment of the antenna 70 of the present invention is shown in perspective view. The various conductive elements consisting of leg elements 200 and 204 (which are generally perpendicular relative to conductive element 206), elements 208 and 210 (which are generally parallel to conductive element 206), feed conductor 220, and crossbar conductor 222 all of which may be formed as a single stamped metal part. The bottom ends of legs 200, 202 are inserted into slots 224 in element 206, and may be soldered or otherwise captured mechanically.

Element leg 204 and element 210 may preferably be wider than corresponding leg element 200 and element 208. Inductors 230, 232 may have extensions 240 leading to an additional turn or turns 242, 244. This construction of the inductor 230, 232 eliminates a separate conductor plate 102, 106 at the end of the coils, 100, 104 as shown in FIG. 4.

Elements 208 and/or 210 may be supported by dielectric post 250 and a dielectric clamp (not shown) at location 252, respectively.

Figure 10:
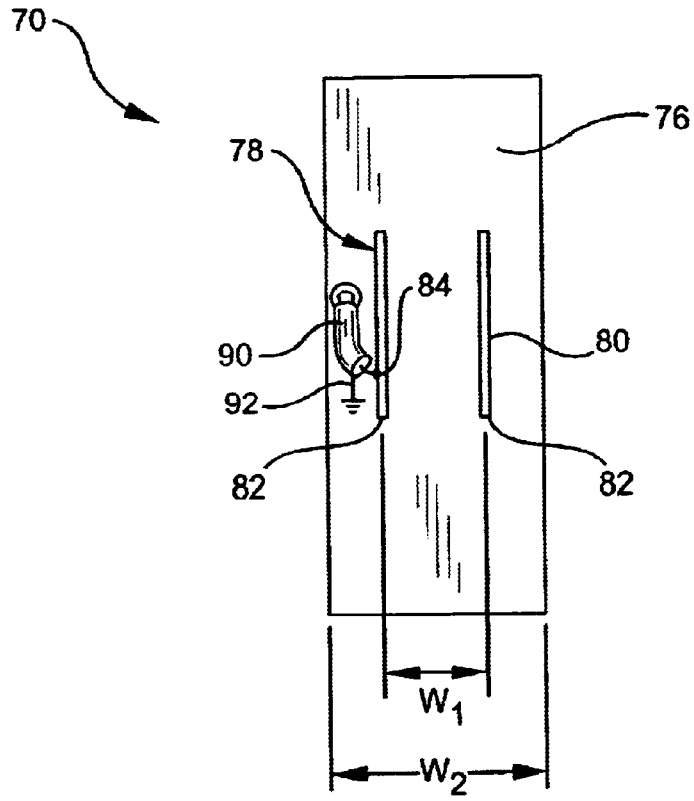
FIG. 10 is a top plan view of the device embodiment of a single-band embodiment of the present invention.
Figure 11:
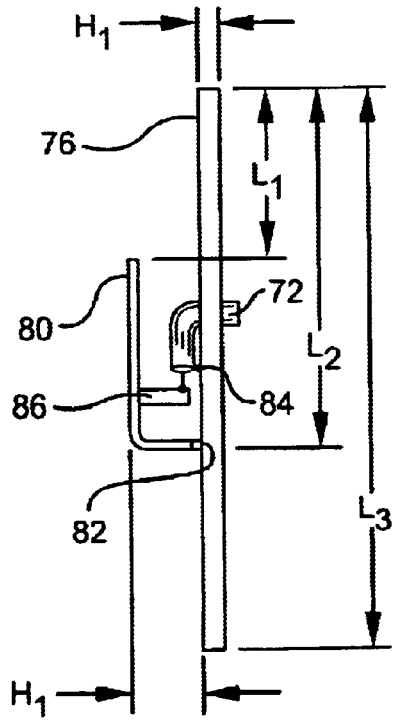
FIG. 11 is a side view of the device embodiment of FIG. 10.

Referring to FIGS. 10 and 11, yet another embodiment of a device according to the present invention is illustrated. Antenna 70 in this embodiment is a single band antenna assembly. In comparison to the dual-band embodiment of FIGS. 3–5, this embodiment of antenna 70 does not require the trap tuning elements, e.g., elements 100, 102, 104, and 106 of FIGS. 4 and 5.

Figure 12:
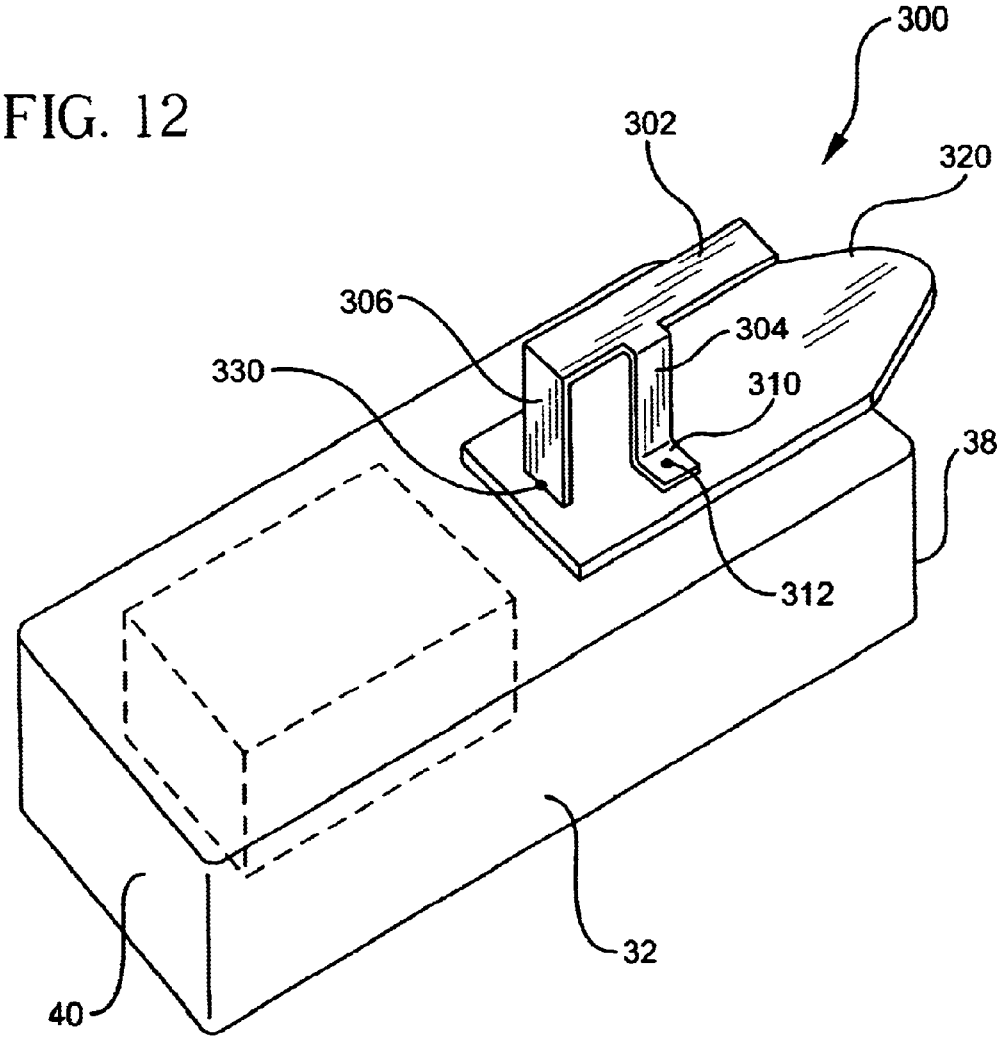
FIG. 12 is yet another embodiment of an antenna according to the present invention.

FIG. 12 shows a single band embodiment of the antenna 300 of the present invention. Antenna 300 is located near the top 38 of PWD 32. The radiating element has three segments 302, 304, 306. A microstrip feed section 310 is shown connected to the rf input/output port of the PWD at 312. A ground plane 320, separate from the internal ground plane of PWD 32, is used. Segment 306 is electrically connected to 320 at location 330. Ground plane 320 may extend beyond the top of PWD 32, and it may be a sliding type as shown in FIG. 7. Ground plane 320 may be provided, at least in part, by the ground traces of the printed wiring board of PWD 32, particularly in an application where antenna 300 is integrated within the PWD 32.

Antenna 300 may function as a single band antenna suitable for operation over the range of 1710–1990 MHz, for example. In one embodiment the dimensions: for ground plane 320 are 1.41 in. by 2.72 in; for segment 306 are 0.57 in. (width) by 0.5 in. (height); and for segment 302 are 0.57 in (width) by 1.46 in. (length). Thickness of all conductors may be in the range of 0.001–0.10 inch, with 0.020 being a preferred thickness. The length of ground plane 320 extending beyond end 38 may be in the range of 0 to 1 inch, with 0.7 in being a preferred dimension. In an embodiment of antenna 300 being incorporated within a PWD 32, ground plane 320 may not extend outside of the PWD 32 housing.

Figure 13:
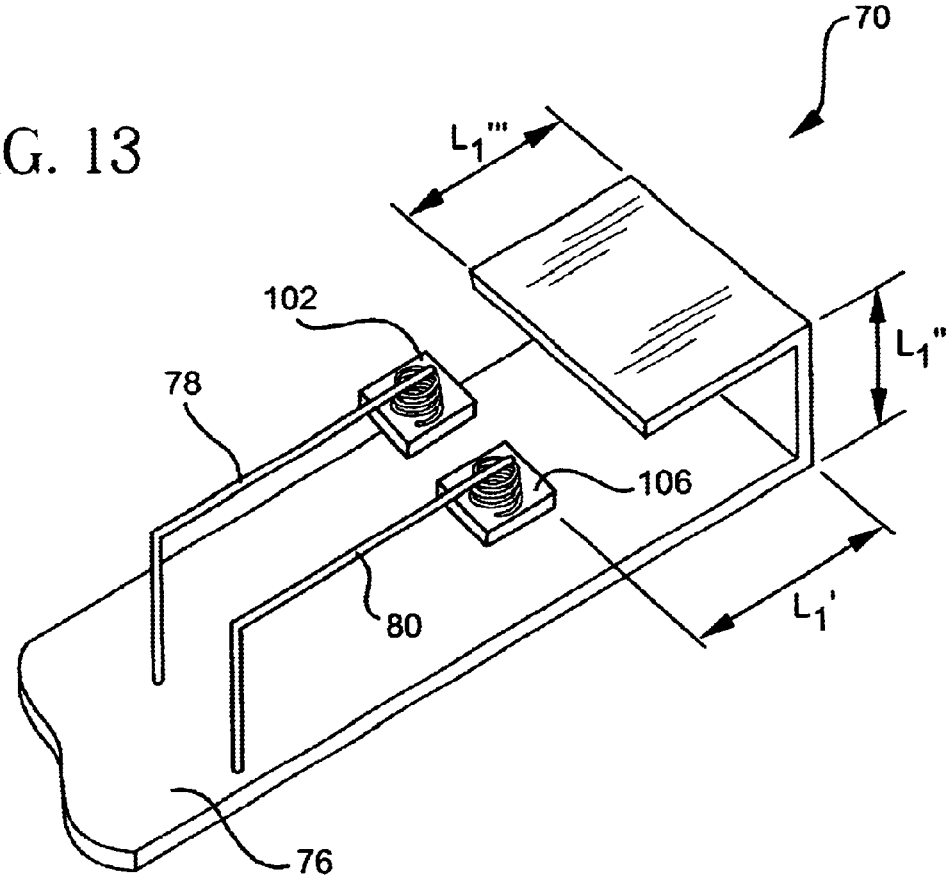
FIG. 13 is yet another embodiment of an antenna according to the present invention.

Referring to FIG. 13, another antenna embodiment 70 with a configured ground plane conductor 76 is shown. The length L1 of conductor 76 of FIG. 5 is replaced by the combination of L1', L1" and L1'". Generally, this combination of segments will have a length equal to or somewhat longer than L1 of FIG. 5, depending on the ratio of L1" to L1'". The function of this feature is to reduce the overall length of conductor 76 from FIG. 5.

Figure 14:
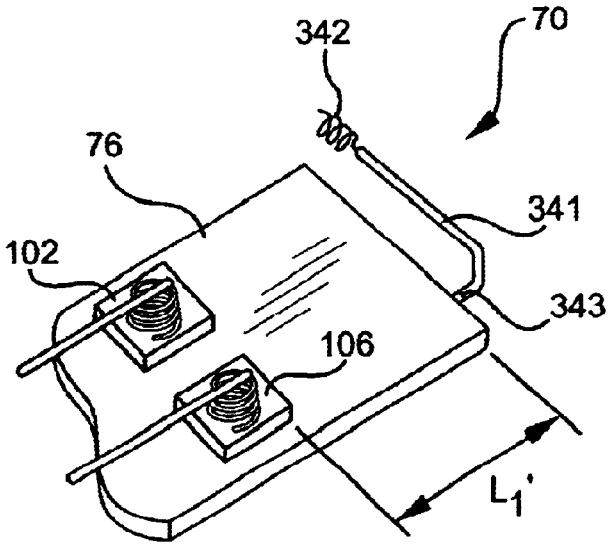
FIG. 14 is yet another embodiment of an antenna according to the present invention.

Referring to FIG. 14, yet another antenna embodiment 70 with a differently configured ground plane conductor 76 is shown. Here conductor 341 and inductor 342 are closely spaced from element 76 and electrically connected to element 76 at location 343. Again, the purpose of this embodiment is to reduce the length of 76.

The above described embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. An apparatus comprising:

a hearing aid having an electronic component for amplifying a signal to be received during use by a human being;

a graspable portable wireless device including reception and transmission circuitry for generating RF signals used to communicate audio communication, said wireless device having an RF signal line, said wireless device having a top and a bottom and being used in proximity to the hearing aid;

a conductive element coupled to a ground plane of said portable wireless device; and first and second elongated elements each having first and second ends, said first ends being connected to said conductive element, said second ends being directed toward the top of the wireless device, wherein the first elongated element is coupled to the RF signal line at a feedpoint, and wherein said second elongated element is parasitically coupled to the first elongated element.

2. The apparatus of claim 1 wherein the first and second elongated elements are in generally parallel alignment.

3. The apparatus of claim 1 wherein the first and second elongated elements are connected by a conductive crossbar element.

4. The apparatus of claim 3 wherein the crossbar element is generally proximate to the first ends of the first and second elongated elements.

5. The apparatus of claim 1 wherein the first and second elements each have an LC trap assembly connected at respective second ends.

6. The apparatus of claim 5 wherein the LC trap assemblies each include a coiled conductive wire element and a generally planar conductor element.

7. The apparatus of claim 5 wherein the LC trap assemblies each include a pair of coiled conductive wire elements and an intermediate conductor element.

8. The apparatus of claim 6 wherein at least one of the coiled conductive wire elements includes non-uniformly spaced wire windings.

9. The apparatus of claim 1 wherein the wireless device has an external antenna port and the conductive element and first and second elongated elements are operatively coupled through said external antenna port.

10. A method of reducing induced RF noise in a hearing aid when used in close proximity to a wireless device, said wireless device having a top and a bottom when in operation, said method comprising the steps of:

providing a conductive element coupled to a ground plane of the wireless device;

providing first and second elongated conductor elements upon the conductive element, said first and second elongated conductor elements each having a first end connected to the conductive element and a second end, said elongated conductor elements being generally directed toward the top of the wireless device;

coupling the first elongated conductor element to an RF signal line of the wireless device; and parasitically coupling the second elongated conductor element to the first elongated conductor element during use.

11. The method of claim 10 further comprising the steps of:

coupling LC traps structures at the second ends of the first and second elongated conductor elements.

12. An antenna device for a wireless device for use in conjunction with a hearing aid adapted to be in proximity to a user's ear, said wireless device having a top and a bottom when in operation, said antenna device comprising:

a conductive element having a length of at least 0.35 times an operational wavelength, said conductive element having an upper edge and a lower edge defined between a middle portion, said conductive element being coupled to a ground plane element of the wireless device;

a driven conductor element being coupled to the conductive element within the middle portion, said driven conductor including a first element being generally perpendicular to the conductive element and a second element being generally parallel to the conductive element, said second element extending toward the top of the wireless device; and a parasitic conductor element coupled to the conductive element at the middle portion, said parasitic conductor including a first element being generally perpendicular to the conductive element and a second element being generally parallel to the conductive element, said second element extending toward the top of the wireless device.

13. The antenna device of claim 12 wherein the conductive element is defined as ground traces upon a printed wiring board of the wireless device.

14. The antenna device of claim 12 wherein the conductive element is substantially planar.

15. The antenna device of claim 12 wherein the second elements of the driven conductor element and parasitic conductor element are substantially parallel.

16. The antenna device of claim 12 wherein the first elements of the driven conductor element and the parasitic conductor element are connected together.

17. The antenna device of claim 12 further comprising one or more LC trap structures for effecting a dual-band operability, said LC trap structures being coupled at a free end of either the driven conductor element or the parasitic conductor element or both.

18. An antenna device for a wireless device suitable for use in conjunction with a hearing aid, said wireless device having a top and a bottom when in operation, said antenna device comprising:

a segmented ground plane element including at a plurality of ground plane segments, at least one of said plurality of segments being movable relative to the another one of said plurality of segments;

a driven conductor element being coupled to the segmented ground plane element, said driven conductor element including a first element being generally perpendicular to the segmented ground plane element and a second element being generally parallel to the segmented ground element, said second element extending toward the top of the wireless device; and a parasitic conductor element coupled to the segmented ground element, said parasitic conductor element including a first element being generally perpendicular to the segmented ground element and a second element being generally parallel to the segmented ground element, said second element extending toward the top of the wireless device.

19. The antenna device of claim 18 wherein the second elements of the driven conductor element and parasitic conductor element are substantially parallel.

20. The antenna device of claim 18 the first elements of the driven conductor element and the parasitic conductor element are connected together element.

21. The antenna device of claim 18 further comprising one or more LC trap structures for effecting a dual-band operability, said LC trap structures being coupled at a free end of either the driven conductor element or the parasitic conductor element or both.

22. An apparatus comprising:

a graspable portable wireless device including reception and transmission circuitry for generating RF signals used to communicate audio communication, said wireless device having an RF signal line, said wireless device having a top and a bottom when in operation;

a conductive element coupled to a ground plane of said portable wireless device; and an elongated element having a first end and a second end and an intermediate portion therebetween, said first end being connected to said middle portion of the conductive element, said second end being directed toward the top of the wireless device, wherein the elongated element is directly coupled to the RF signal line at a feedpoint.

23. The apparatus of claim 22 further comprising a second elongated element having a first end and a second end, said first end being connected to the conductive element and said second elongated end being directed toward the top of the wireless device, said second elongated element being parasitically coupled to the elongated.

24. The apparatus of claim 23 wherein the conductive element is defined as ground traces upon a printed wiring board of the wireless device.

25. The apparatus of claim 23 wherein the conductive element is substantially planar.

26. The apparatus of claim 23 wherein the elongated element and the second elongated element are connected together.

27. The apparatus of claim 22 further comprising a LC trap structure for effecting a dual-band operability, said LC trap structure being coupled at a free end of the elongated element or the second elongated element or both.

* * * * *